US005775541A

United States Patent [19]

Perkins

[11] Patent Number: 5,775,541

[45] Date of Patent: Jul. 7, 1998

[54] LIQUID CONTAINER AND VALVE

[75] Inventor: David W. Perkins, Hiawatha, Iowa

[73] Assignee: Plastic Systems, Inc., Des Moines, Iowa

[21] Appl. No.: 694,874

[22] Filed: Aug. 9, 1996

Related U.S. Application Data

[60] Division of Ser. No. 519,077, Aug. 24, 1995, Pat. No. 5,579,953, which is a continuation-in-part of Ser. No. 298, 405, Aug. 30, 1994, abandoned.

[51] Int. Cl.[6] ..... B65D 35/48

[52] U.S. Cl. ..... 222/105; 222/559; 222/541.5; 222/499

[58] Field of Search ..... 222/95, 105, 107, 222/501, 507, 522, 523, 541.6, 541.5, 559, 499

[56] References Cited

U.S. PATENT DOCUMENTS

| | | | |
|---|---|---|---|
| 1,958,429 | 5/1934 | Hartog | 222/499 |
| 2,924,041 | 6/1960 | Jackson et al. . | |
| 3,206,075 | 9/1965 | Scholle | 222/105 |
| 3,252,634 | 5/1966 | Scholle . | |
| 3,310,206 | 3/1967 | Littlefield | 222/541 X |
| 3,604,596 | 9/1971 | Worth et al. | 222/541 |
| 3,690,520 | 9/1972 | Sarris | 222/499 |
| 4,322,018 | 3/1982 | Rutter . | |
| 4,353,488 | 10/1982 | Schneiter et al. | 222/501 |
| 4,375,864 | 3/1983 | Savage . | |
| 4,421,146 | 12/1983 | Bond et al. . | |
| 4,475,670 | 10/1984 | Rutter . | |
| 4,679,618 | 7/1987 | Farkas . | |
| 4,779,774 | 10/1988 | Morel | 222/522 |
| 4,801,124 | 1/1989 | Liebel . | |
| 4,893,728 | 1/1990 | Jennings et al. | 222/499 X |
| 4,948,014 | 8/1990 | Rutter et al. . | |
| 5,042,698 | 8/1991 | Fessell | 222/559 X |
| 5,297,697 | 3/1994 | Boring | 222/541 X |

FOREIGN PATENT DOCUMENTS

| | | | |
|---|---|---|---|
| 2 088 837 | 6/1982 | United Kingdom | 222/105 |
| 2 225 839 | 6/1990 | United Kingdom | 222/559 |

*Primary Examiner*—Kenneth Bomberg
*Attorney, Agent, or Firm*—Merchant, Gould, Smith, Edell, Welter & Schmidt, P.A.

[57] ABSTRACT

Apparatus having a valve for a container intended to hold liquid. The valve includes an inner conduit which can be easily assembled through flexible fingers of an outer sleeve. The inner conduit both moves axially relative to the outer sleeve between open and closed positions and circumferentially so that the inner conduit can be threaded with respect to a mating hose. A tab which functions to stop the valve in the closed position, as well as in the open position, includes tamper-evident structure.

3 Claims, 9 Drawing Sheets

LIQUID CONTAINER AND VALVE

This is a Divisional of application Ser. No. 08/519,077, filed Aug. 24, 1995, now U.S. Pat. No. 5,579,953, and which application is a Continuation-In-Part of application Ser. No. 08/298,405 filed Aug. 30, 1994, now abandoned.

FIELD OF THE INVENTION

The present invention is directed to liquid containers having valves and, more particularly, to a container with a valve comprising a pair of parts in telescoping arrangement with a sealing mechanism between them.

BACKGROUND OF THE INVENTION

Containers for liquid can have rigid walls with a valve attached thereto or can be flexible with support provided by an additional containing member, like a cardboard box. In the latter case, the valve is usually attached to the flexible container and supported by the cardboard box.

A prior valve is shown in U.S. Pat. No. 3,252,634 wherein an outer tube component is fastened to the flexible container and an inner tube component has an aperture in its wall and moves between a closed position and an open position. A rubber band functions as an aid in keeping the two components together in the closed position. This valve functions essentially as a spigot and is not intended for dispensing from the container into a hose.

The valve of U.S. Pat. No. 4,375,864 provides for a tubular probe attached to a hose to be inserted into a probe channel of a spout. The spout is sealed with a plug. The probe fits into the channel and snaps onto the plug so the plug is pushed into the bag to permit fluid to flow from the bag through apertures in the probe. Withdrawing the probe snaps the plug back into a sealing arrangement.

Conventional valves for use in dispensing liquid to hoses have tended to have complex shapes or multiple parts. They have commonly been of relatively low quality and not sufficiently durable for large containers dispensing into large hoses. The present valve combines a simple two-component design with a shape which allows for a relatively sizeable drain to a hose. The present valve is easy to assembly, reliably seals, provides tamper indication, and can be opened and closed numerous times without reducing reliability.

SUMMARY OF THE INVENTION

The present invention is directed to an apparatus for containing and dispensing a liquid including a container, a valve, and a mechanism for fastening the container and the valve together. The valve includes an outer sleeve and an inner conduit. The inner conduit has a cylindrical wall with a flange near one end and an aperture near the other. The inner conduit fits within the outer sleeve in fluid-tight, telescopic arrangement. The outer sleeve has flexible fingers such that they flex to allow the flange of the inner conduit to slide through them during assembly and then prevent the flange from sliding back through them after assembly.

The inner conduit is threaded so that when a wrench is applied to the flange, the inner conduit can be turned onto a threaded hose connector.

Although not necessary, the valve includes a tab which prevents the valve from initially opening without showing evidence of tampering and, once opened, could hold the valve in the open position or, when closed again, could hold the valve in the closed position until again opened.

The outer sleeve and inner conduit of the valve slide in telescopic arrangement, but maintain a fluid-tight seal between them, preferably with O-rings. O-ring grooves are formed to have parallel side walls, a bottom wall perpendicular to the side walls and extending from one of the side walls, and an oblique wall interconnecting the other of the side walls and the bottom wall. With such groove, the O-ring can be crushed sufficiently, but not so much as to create friction which would prevent sliding of the inner conduit relative to the outer sleeve. In this way, the O-ring does not roll, yet provides some friction during sliding of the inner conduit.

The present invention is also directed to the method of assembly which provides for installing O-rings in the O-ring grooves, aligning one end of the inner conduit with an end of the outer sleeve so that the corners of the flange of the inner conduit are aligned with the slots between the fingers of the outer sleeve. The inner conduit is slid into the outer sleeve. The fingers are flexed until the flange passes completely beyond them. The fingers advantageously prevent the flange from passing back through them. Stop surfaces on opposite sides of the fingers prevent the inner conduit from passing completely through the outer sleeve.

The present valve has a simple design and because of it, is durable so as to be available for use for relatively large containers which drain into high volume, relatively large diameter hoses.

The present invention can be better understood with reference to the drawings which are now briefly described and the detailed description which follows thereafter.

BRIEF DESCRIPTION OF THE DRAWINGS

5

DETAILED DESCRIPTION OF THE PREFERRED EMBODIMENT

Figure 1:
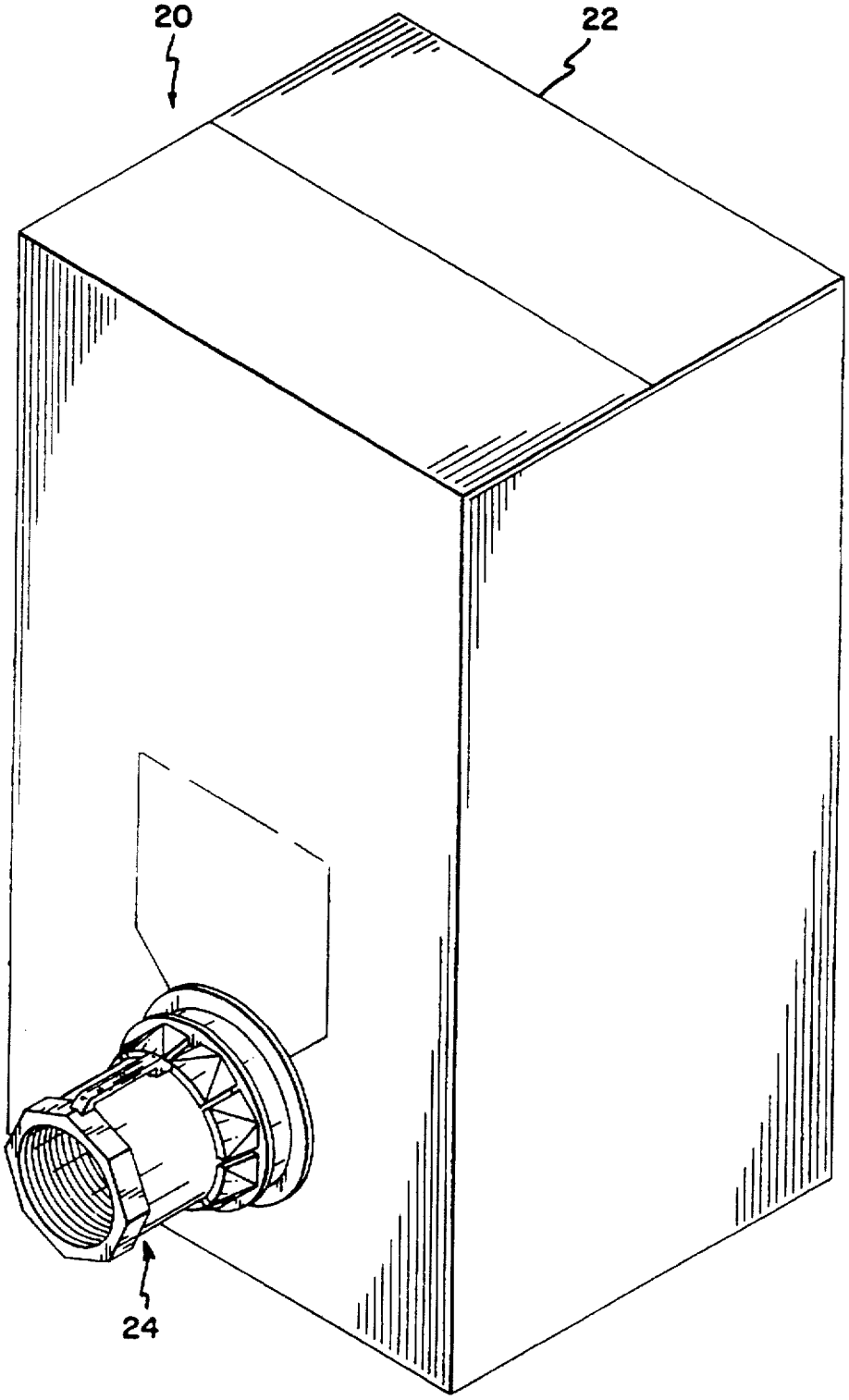
FIG. 1 is a perspective view of a cardboard box with a valve supported thereby.
Figure 2:
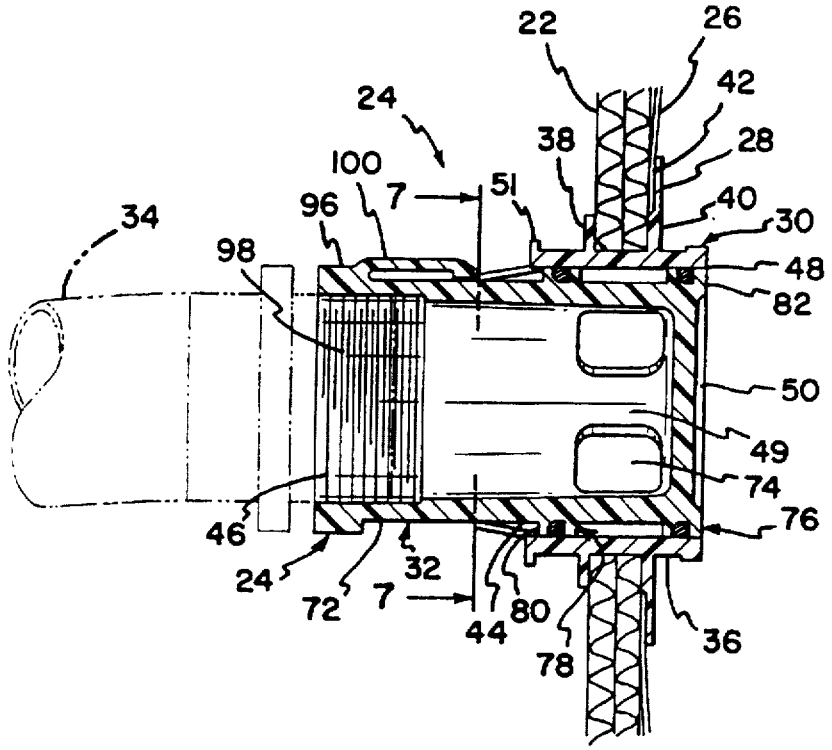
FIG. 2 is a cross-sectional view of the valve in a closed position.
Figure 3:
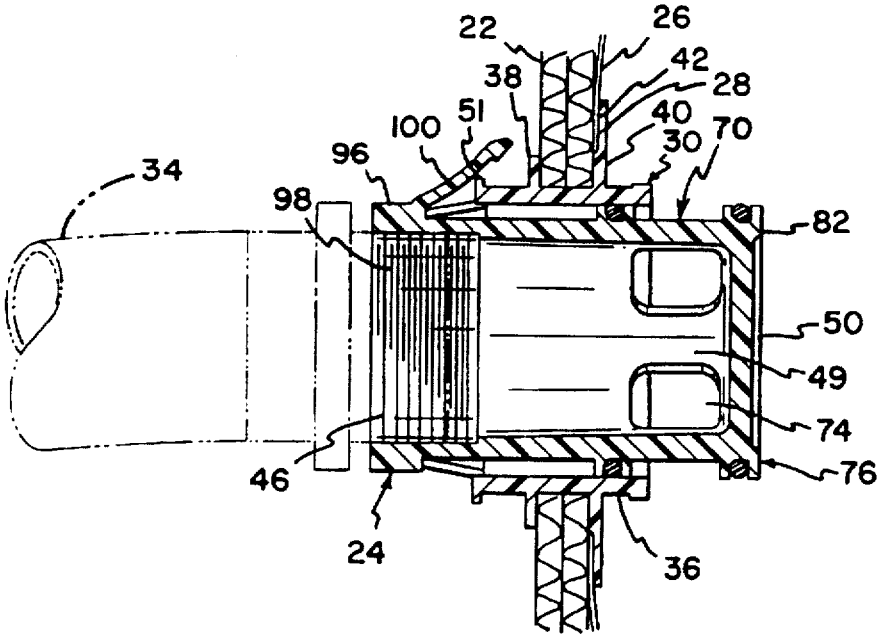
FIG. 3 is a cross-sectional view of the valve in the open position.

The present invention is now described in detail with reference to the drawings wherein like reference numerals designate identical parts throughout the various views. With reference to FIG. 1, apparatus in accordance with the present invention is designated generally by the numeral 20. Apparatus 20 includes a cardboard box 22 with a valve 24 projecting therefrom. As shown in FIGS. 2 and 3, a flexible container 26 is fastened to ring 40 of valve 24 with a heat seal weld 28 as further described hereinafter.

With reference then to FIGS. 2 and 3, valve 24 includes outer sleeve 30 and inner conduit 32. Outer sleeve 30 provides mechanism for allowing box 22 to support valve 24, as well as mechanism for receiving and supporting inner conduit 32. Inner conduit 32 is moveable between open and closed positions to provide fluid communication as desired with hose 34.

Figure 14:
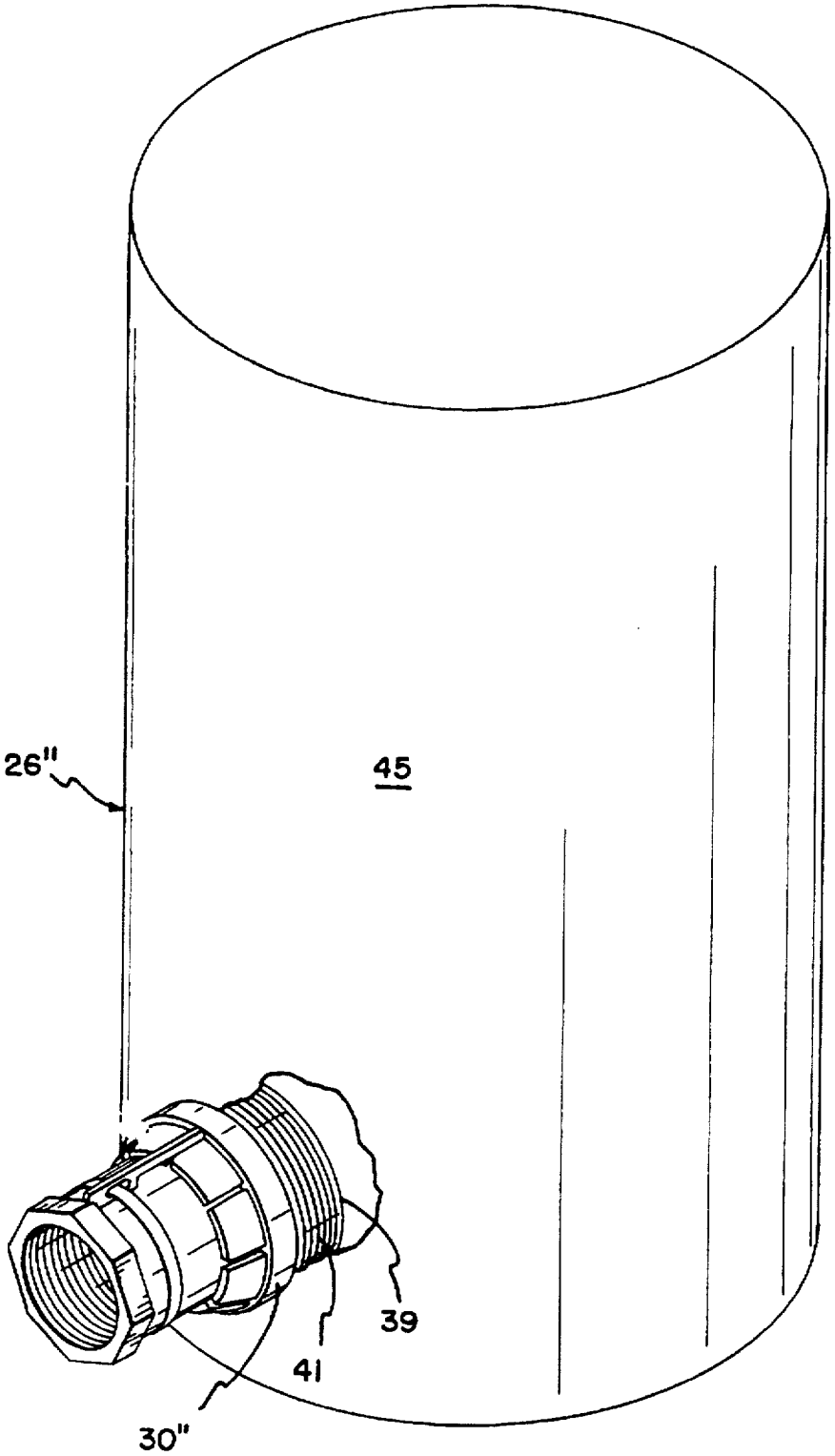
FIG. 14 is a perspective view of another alternative embodiment of the valve as threaded into a rigid wall of a container.

Outer sleeve 30 has a cylindrical body 36. A pair of rings 38, 40 are integral with body 36 and extend outwardly from it. Ring 40 extends farther radially outwardly than ring 38 and includes an indented region 42. Indented region 42 has a depth approximately equal to the thickness of flexible container 26 and functions to receive flexible container 26 between ring 40 and box 22. A heat seal process as known to those skilled in the art provides a fastening weld 28 to attach flexible container 26 to a surfaces of ring 40. Flexible container and ring 40 are made of a material compatible with fastening them together by the heat seal process, such as polyethylene. As shown in FIG. 14, alternatively, outer sleeve 30" could have first threads 39 (rings 38 and 40 being eliminated) threaded into second threads 41 in an opening in a rigid wall 45 of container 26". Rings 38 and 40 are spaced in an axial direction approximately the width of the wall of box 22. Rings 38 and 40 can be near one end or the other of outer sleeve 30, but are shown approximately equally spaced on opposite sides of the center of body 36.

Outer sleeve 30 and inner conduit 32 have open first and second distal ends 44 and 46, respectively. Outer sleeve 30 also has an open proximal end 48, while inner conduit 32 has a proximal end 49 closed with a wall 50. Outer sleeve 30 at its distal end has a flange 51 which extends outwardly from body 36. Flange 51 provides an engagement member for tab 100 as discussed hereinafter.

Figure 7:
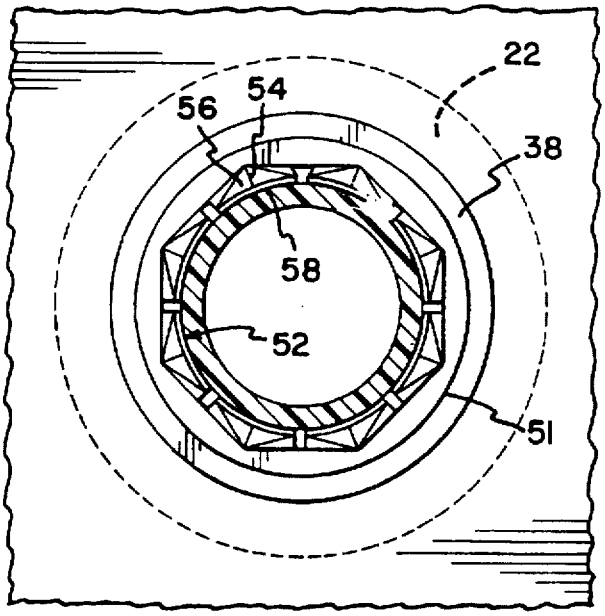
FIG. 7 is a cross-sectional view taken along line 7—7 of FIG. 2.
Figure 11:
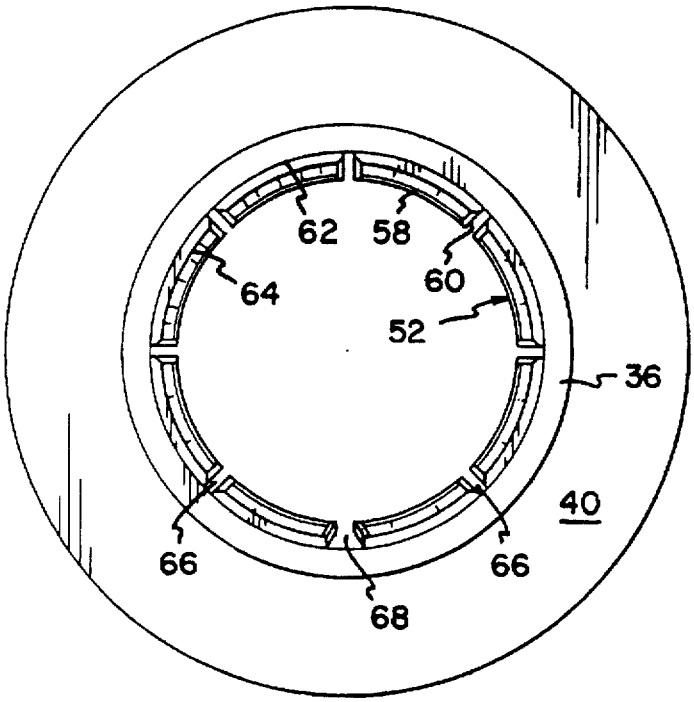
FIG. 11 is an end view looking in a direction opposite that of FIG. 7.

Fingers 52 are inclined somewhat inwardly and extend generally axially and in a distal direction from the distal end of outer sleeve 30. As shown in FIGS. 7 and 11, there are 8 fingers 52 in the present embodiment of valve 24. It is understood, however, that there could be a different number. As shown in FIG. 7, each finger 52 has a center apex 54 and has a width which decreases as the finger extends more distally. In this way, portion 56 more distal from the distal end of body 36 of outer sleeve 30 has a truncated, triangular cross-section. It is understood, however, that fingers 52 could have a different shape while still accomplishing the functions needed. The most distal end of each of fingers 52 has a bevel 58 extending inwardly. Likewise, as shown in FIG. 11, the side edges of each of fingers 52 have bevels 60 extending inwardly. Fingers 52 are an integral part of outer sleeve 30. The proximal end of fingers 52 extend radially inwardly from the cylindrical interior surface 62 of outer sleeve 30. The radial surface 64 thus created by the proximal end of fingers 52 provides a stop for ring member 78. The radial surface at the other end of fingers 52 provides stop for flange 96.

Figure 8:
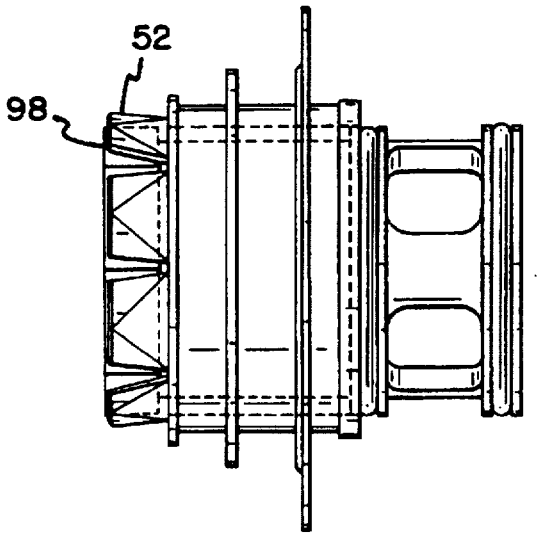
FIG. 8 is a side view of the valve of FIGS. 1–3 showing the assembly of the inner conduit to the outer sleeve.
Figure 9:
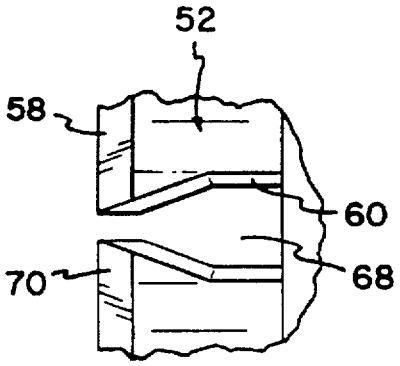
FIG. 9 is a plan view of one of the grooves between the fingers of the valve of FIGS. 1–3.
Figure 10:
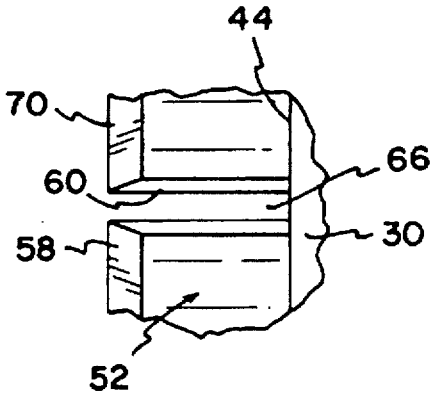
FIG. 10 is a plan view of a groove different from that of FIG. 9, between the fingers of the valve of FIGS. 1–3.

The grooves 66 between all pairs of adjacent fingers 52 are the same as shown in FIG. 10, except for one groove 68 between a pair of adjacent fingers 52 as shown in FIG. 9. Groove 68 is wider at the proximal end and more narrow at the very distal end. Groove 68 is intended to receive tab 100 during assembly, while the other grooves receive the various corners of flange 96. Grooves 66 and 68 extend from the distal end 44 of outer sleeve 30 to the distal end 70 of fingers 52. The grooves in combination with the flexibility of fingers 52 function to receive tab 100 and the corners of flange 96 in the empty space of the grooves and allow the fingers to flex as needed so that the larger portions of flange 96 and tab 100 can pass through the fingers of outer sleeve 30 as shown in FIG. 8.

Inner conduit 32 has a cylindrical body 72. As indicated hereinbefore, the proximal end 49 of inner conduit 32 includes wall 50 which closes the proximal end 49. A plurality of apertures 74 are formed in body 72 near wall 50. Ring members 76 and 78 project radially outwardly from body 72 and are spaced approximately the axial length of apertures 74, with ring member 76 being proximal from apertures 74 and ring member 78 being distal from apertures 74. The distal wall 80 of ring member 78 contacts radial surface 64 formed by fingers 52 when the proximal wall 82 of ring member 76 is flush with the proximal end surface of outer sleeve 30.

Figure 6:
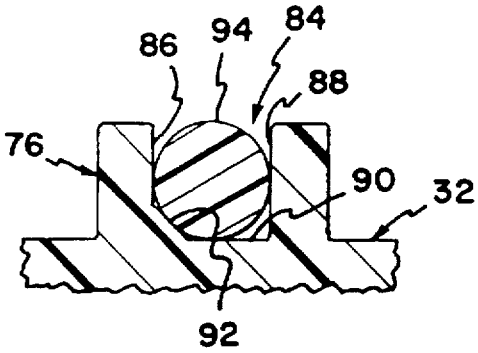
FIG. 6 is a cross-sectional, detail view of an O-ring and O-ring groove used in the valve of the present invention.

As shown in FIG. 6, each of ring members 76 and 78 includes an O-ring groove. The grooves in each of the ring members are the same so groove 84 of ring member 76 is described. Groove 84 includes parallel sidewalls 86 and 88, a bottom wall 90 perpendicular to wall 88, and an oblique wall 92 interconnecting bottom wall 90 and sidewall 86. Preferably, oblique wall 92 is more distal than longer sidewall 88. An O-ring 94 fits in groove 84.

O-ring groove 84 differs from a conventional O-ring groove with the inclusion of oblique wall 92. In testing it was found that a conventional O-ring and O-ring groove required crushing of the O-ring too much in order to maintain the various dimensional relationships required among flange 96, surface 64 of fingers 52, and ring member 78 to achieve assembly as desired and also subsequent valve functioning as described herein. If the size of the O-ring was reduced without reducing the groove, then once sliding of inner conduit 32 started relative to outer sleeve 30, the O-ring rolled and did not maintain sufficient friction. The bottom wall 90 and oblique wall 92, on the other hand, provide for a space into which the O-ring can be crushed. With this configuration, it was found that the O-ring does not roll and, on the other hand, gives sufficient friction to brake the inner conduit from easily sliding relative to the outer sleeve. Although not preferred, lubrication on the O-ring may sometimes be desired.

The spaced apart ring members 76 and 78 further provide stability for inner conduit 32 relative to outer sleeve 30 and also provide the sealing mechanism between the two items. It is understood in addition that the sealing function need not be provided by O-rings, but could, for example, be provided by flexible rings or skirts extending inwardly.

Inner conduit 32 includes flange 96 at distal end 46. Flange 96 has a regular polygonal perimeter, preferably octagonal. The number of corners created by the various intersecting surfaces equals the number of grooves 66 and 68. Inner conduit 32 has an interior thread 98 at the distal end in order to receive mating threads of hose 34. Flange 96 functions to provide surfaces for a wrench to grasp in order to tighten the mating threaded portions of inner conduit 32 and hose 34.

Figure 4:
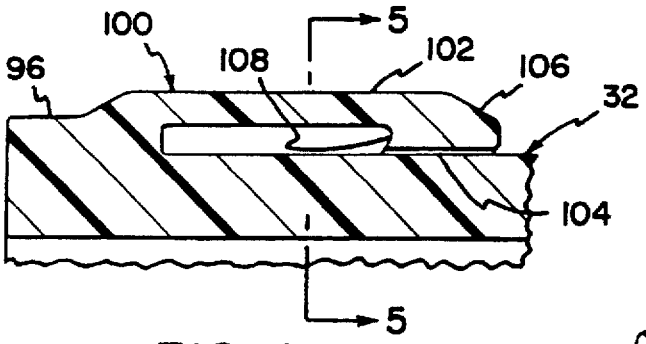
FIG. 4 is a cross-sectional, detail view of the tab of the valve of FIGS. 1–3.
Figure 5:
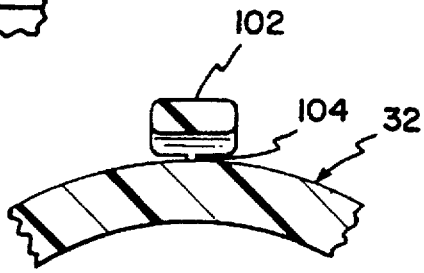
FIG. 5 is a cross-sectional view taken along line 5—5 of FIG. 4.

A tab 100 extends in a proximal direction from flange 96. With reference to FIGS. 4 and 5, tab 100 is a cantilever member 102 formed in the shape of a hook and has a first portion integral with flange 96. Tab 100 is supported at its outwardmost end by a second portion in the form of membrane 104. Membrane 104 is integral with both the body 72 of inner conduit 32 and the outermost end of tab 100. During assembly of valve 24, tab 100 passes through slot 68. During use, membrane 104 provides evidence of tampering. That is, when valve 24 is moved from a closed to an open position, membrane 104 is broken as the outermost end 106 of tab 100 slides up one of fingers 52. The inner hook portion 108 of tab 100 engages flange 51 when valve 24 is in the fully open position and then functions to hold valve 24 in the open position. Tab 100 can be manually flexed outwardly as shown in FIG. 3 to release it from flange 51 so that valve 24 can be closed again. Valve 24 is readily cycled between open and closed positions thereafter.

In use, the present invention is particularly easy to assemble. First, O-rings are installed in grooves 84 of inner conduit 32. Then, the second distal end 46 of inner conduit 32 is aligned with the first proximal end 49 of outer sleeve 30 so that the corners of flange 96 are aligned with slots 66 between fingers 52. In this regard, tab 100 is aligned with slot 68. Inner conduit 32 is then slid into outer sleeve 30. Flange 96 and tab 100 pass inside surface 64, and fingers 52 flex outwardly so that flange 96 and tab 100 can pass through them. When flange 96 and tab 100 have passed completely beyond fingers 52 so that they no longer are required to flex, valve 24 is assembled.

In the fully assembled state, valve 24 is closed when both O-rings are in contact with inner wall 62 of outer sleeve 30. Valve 24 is open when only the O-ring and ring portion 78 is in contact with wall 62, the O-ring in ring portion 76 is not in contact with wall 62, and fingers 52 contact flange 96 to prevent any movement of inner conduit 32 in a proximal direction with respect to outer sleeve 30.

Figure 12:
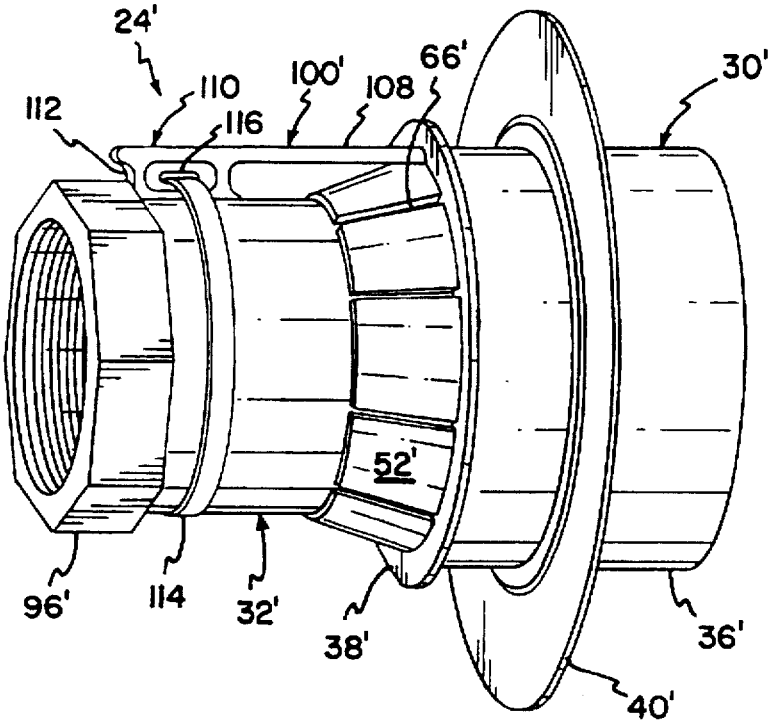
FIG. 12 is a perspective view of an alternate embodiment of the valve of the present invention.

Tab 100 and its method of functioning was described hereinbefore. Valve 24', shown in FIG. 12, is an alternate embodiment with tab 100' extending from outer sleeve 30', as distinguished from the embodiment of FIGS. 1–11 wherein tab 100 extends from flange 96 of inner conduit 32. Valve 24' is preferred over valve 24. In comparison, flange 51 is eliminated in valve 24' and rings 38' is moved to the distal end of body 36'. Tab 100' extends in a distal direction from integral attachment with ring 38'. Tab 100' may also be in attachment with one of fingers 52'. It is noted that since tab 100' is a part of outer sleeve 30' that all the grooves between fingers 52' are the same, namely, grooves 66'. A groove similar to groove 68 is not present.

Figure 13:
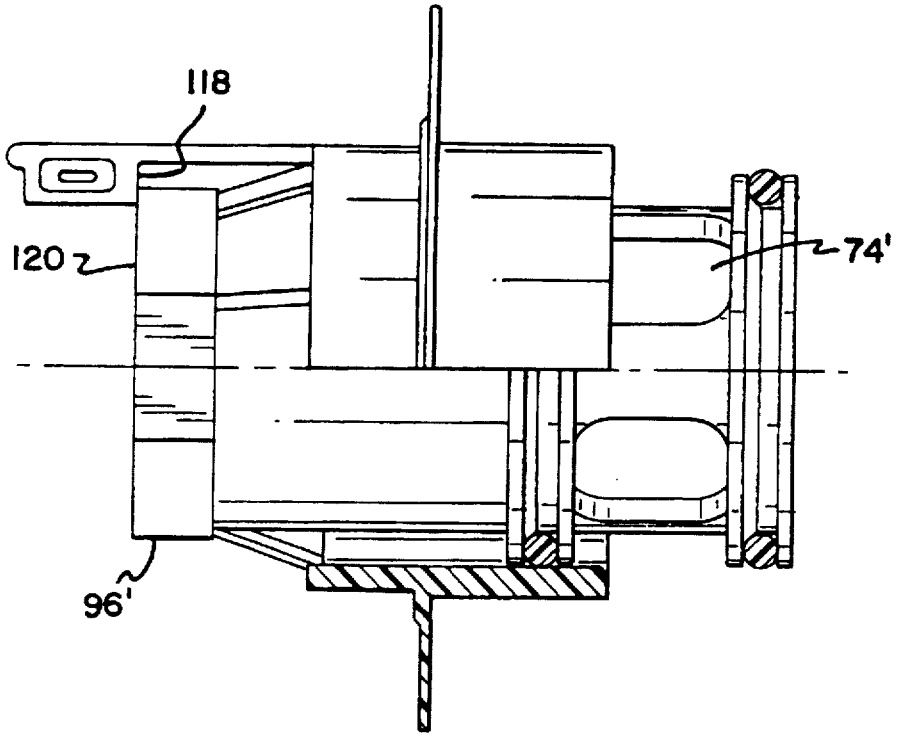
FIG. 13 is a partial cross-sectional, side view of the valve of FIG. 12 in the open position.

Tab 100' is formed to have a cantilevered member 108 extending from ring portion 38'. Hook portion 110 at the most distal end has a distal wall 112 which contacts flange 96'. A tie-down filament 114 is tightly fastened around body 36' and through an opening 116 in hook portion 110 to hold hook portion 110 against body 36' so that distal wall 112 stops inner conduit 32' from moving valve 24' from a closed position to an open position. It is understood that filament 114 may be a string, a wire, a plastic filament, or the like so long as it functions as indicated. Filament 114 provides evidence of tampering with valve 24'. That is, when it is desired to open valve 24', filament 114 is cut so as to free tab 100' from inner conduit 32'. Tab 100' is then manually flexed upwardly so that inner conduit 32' can be moved to the open position where flange 96' contacts fingers 52'. As shown in FIG. 13, when valve 24' is fully opened, the proximal wall 118 of hook portion 110 contacts the distal end 120 of flange 96' and locks valve 24' open. Tab 100' can be manually flexed outwardly again so that inner conduit 32' can be moved to the closed position. Functioning of valve 24' between open and closed is readily done a multiple of times.

It is noted that in the open position, as shown in FIG. 13, flow passes from outside of valve 24' through apertures 74'. Flow continues through inner conduit 32' and out the distal end. Except where differences are indicated, valve 24' is otherwise the same as valve 24.

Figure 15:
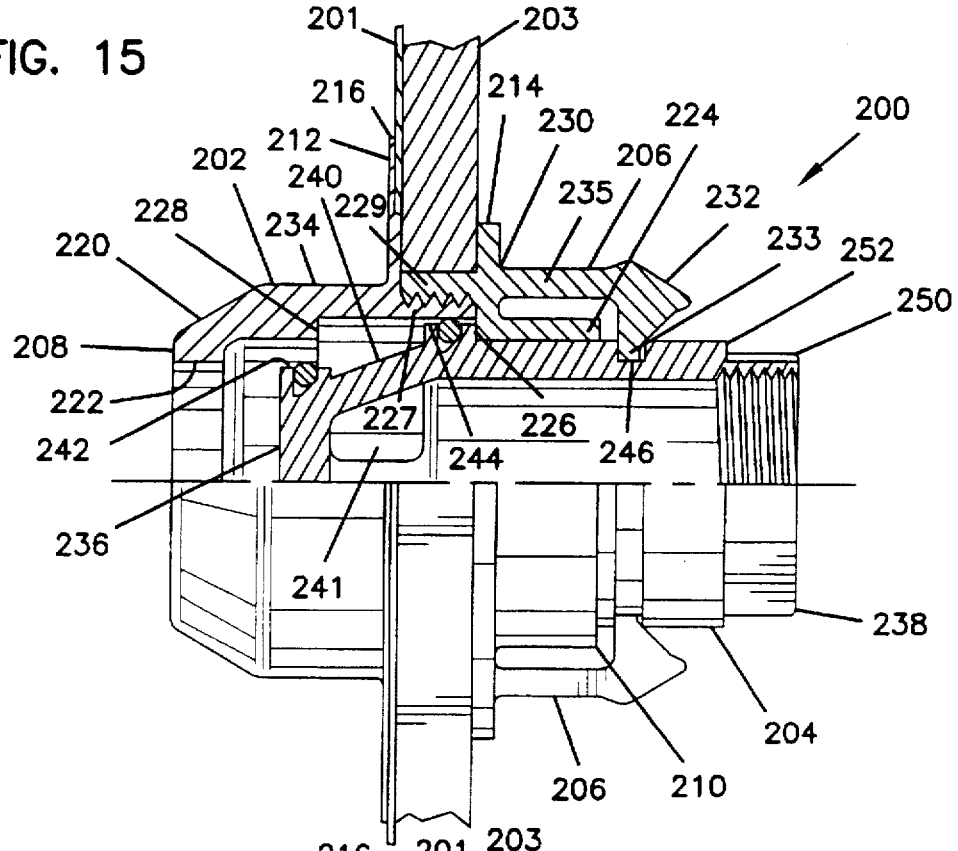
FIG. 15 is a partial cut away view of an alternative valve embodiment constructed in accordance with the principles of the present invention, the valve is shown in the open position.
Figure 16:
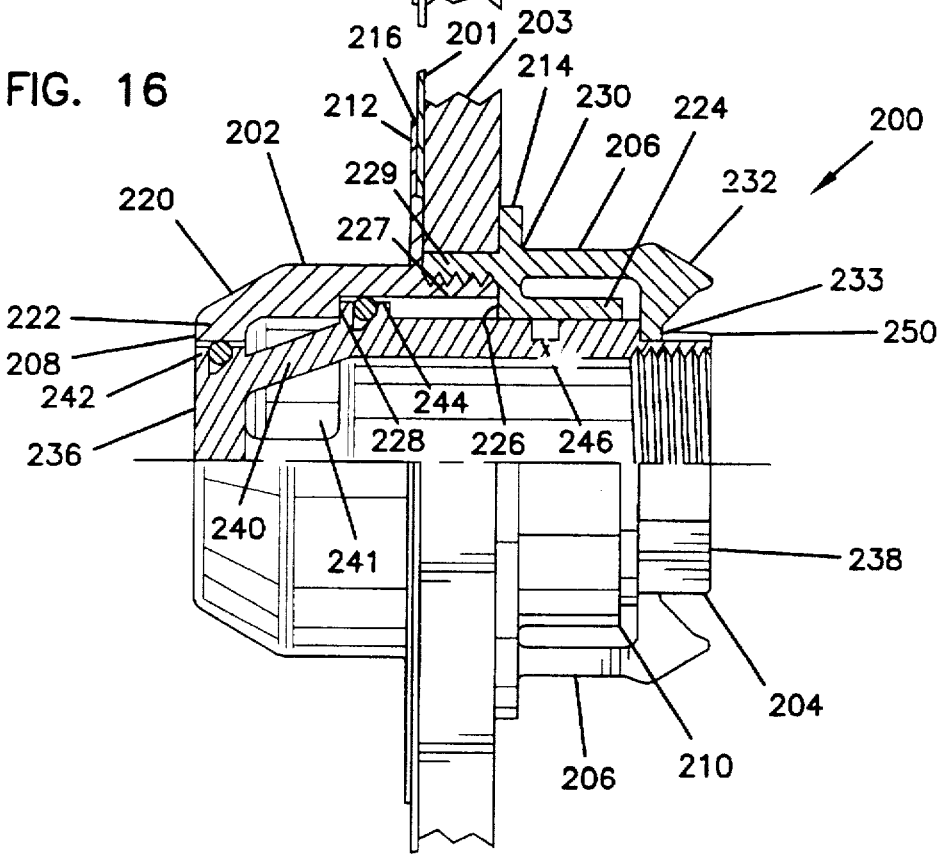
FIG. 16 is a partial cut away view showing the valve of FIG. 15 in the closed position.
Figure 17:
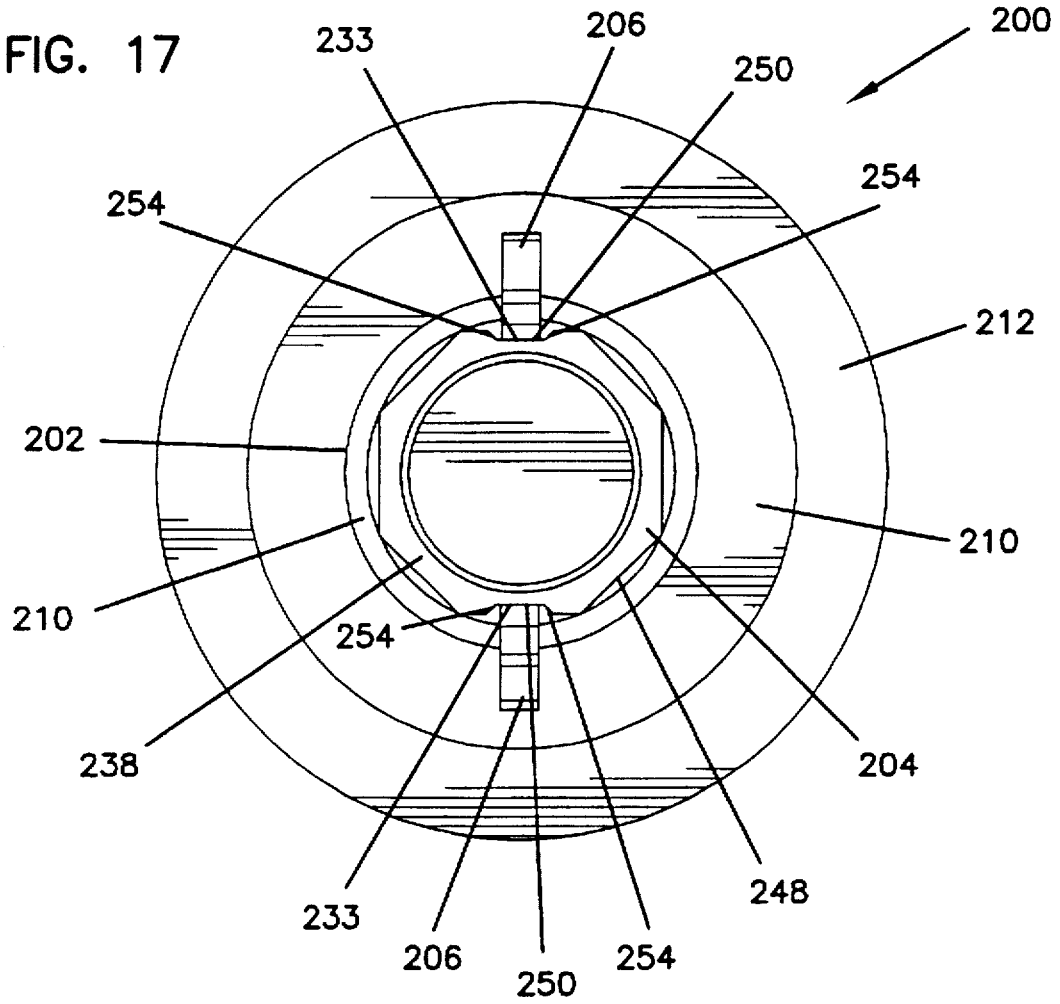
FIG. 17 is an end view of the valve of FIGS. 15 and 16.

FIGS. 15–17 show a valve 200 which is an alternative embodiment of the present invention. The valve 200 preferably has an outer sleeve 202 that is preferably fastened to a flexible container 201 with a heat seal weld as previously described in the specification. The valve 200 also preferably includes an inner conduit 204 that is telescopically mounted within the outer sleeve 202. When the inner conduit 204 is pushed telescopically into the outer sleeve 202 (as shown in FIG. 16), the valve 200 is closed and liquid is prevented from flowing through the inner conduit 204. When the inner conduit 204 is pulled telescopically outward from the outer sleeve 202 (as shown in FIG. 15), fluid communication between the interior volume of the flexible container 201 and the inner conduit 204 is opened. The valve 200 also preferably includes a pair of flexible cantilever members 206 located on opposite sides of the valve 200 for locking the valve 200 in the open and closed positions.

The outer sleeve 202 is preferably a hollow generally cylindrical body having an open first proximal end 208 opposite from an open first distal end 210. Integrally formed with the outer sleeve 202 are first and second ring members 212 and 214. The first and second ring members 212 and 214 are axially spaced apart and extend radially outward from the outer surface of the outer sleeve 202. As previously described in the specification, the spaced apart rings 212 and 214 define an annular slot for receiving the cardboard box 203 of the container 201. Additionally, the first ring 212 preferably has an indented region 216 to which the flexible liner of the container 201 is attached preferably by heat welding. The indented region 216 provides clearance between the cardboard box 203 and the first ring 212.

A first tapered portion 220 of the outer sleeve 202 is preferably located adjacent to the first proximal end 208 of the outer sleeve 202. The first tapered portion 220 preferably tapers diametrically inward as the first tapered portion 220 extends in a proximal direction. An end ring 222 is integrally formed with the body of outer sleeve 202 at the first proximal end 208 of the outer sleeve 202. The end ring 222 extends radially inward and defines a first proximal end opening of the outer sleeve 202. It will be appreciated the diameter of the opening defined by the end ring 222 is less than the inner diameter of the remainder of the outer sleeve 202.

The outer sleeve 202 also preferably includes an extended support tube portion 224. The support tube portion 224 is located adjacent to the first open distal end 210 of the outer sleeve 202 and preferably has a constant inner diameter. The extended support tube portion 224 provides an extended cylindrical surface for contacting the outer surface of the inner conduit 204 in order to minimize rocking of the inner conduit 204 within the outer sleeve 202. Additionally, the proximal end of the support tube portion 224 forms a first annular stop 226 extending radially inward from the inner surface of the outer sleeve 202. A second annular stop 228 is preferably located adjacent to the distal edge of the first tapered portion 220. The first and second annular stops 226 and 228 together function to limit the range of motion of the inner conduit 204 within the outer sleeve 202.

The cantilever members 206 of the valve 200 preferably extend longitudinally outward from the first distal end 210 of the outer sleeve 202. The cantilever members 206 are located on opposite sides of the outer sleeve 202 and preferably have base ends 230 which are integrally formed with the outer sleeve 202. The cantilever members 206 also have free ends 232 which preferably include a tab member or hook 233.

The cantilever members 206 are preferably constructed of a flexible and resilient material such that the free ends 232 of the cantilever members 206 can be selectively flexed away from the outer surface of the inner conduit 204. When the cantilever members 206 are not being flexed away from the inner conduit 204, the free ends 232 preferably engage grooves, slots, other openings, flanges, or lips defined by the inner conduit 204 to retain the inner conduit 204 in the open or closed position. The method of engagement between the cantilever members 206 and the inner conduit 204 will be described in greater detail later in the specification.

For the purpose of facilitating assembly of the valve 200, it is preferred for the outer sleeve 202 to be constructed of separate proximal and distal pieces 234 and 235. The proximal piece 234 is a generally cylindrical body having the closed first proximal end 208 of the outer sleeve 202 located opposite from a threaded first intermediate end 227. The distal piece 235 is a generally cylindrical body having the open first distal end 210 of the outer sleeve 202 located opposite from a threaded second intermediate end 229. The distal and proximal pieces 234 and 235 are joined together to form the outer sleeve 202 by threadingly mating the first and second intermediate ends 227 and 229.

The inner conduit 204 of the valve 200 is preferably a cylindrical body having a closed second proximal end 236 and an open second distal end 238. The inner conduit 204 includes a second tapered portion 240 located adjacent to the second proximal end 236 of the inner conduit 204. The second tapered portion 240 tapers diametrically inward as the second tapered portion 240 extends toward the second proximal end 236 of the inner conduit 204.

The inner conduit 204 also includes first and second sealing ring members 242 and 244 which are integral with the outer surface of the inner conduit 204. The first sealing ring member 242 extends radially outward from the inner conduit 204 at a location proximal from the second tapered portion 240 and generally adjacent to the second proximal end 236 of the inner conduit 204. The second sealing ring member 244 also extends radially outward from the outer surface of the inner conduit 204 and is located distal from the second tapered portion 240. The tapered portion 240 defines one or more apertures 241 for allowing fluid communication between the inner volume of the container 201 and the open second distal end 238 of the inner conduit 204 when the valve 200 is in the open position.

Similar to the previously described embodiments, the first and second sealing ring members 242 and 244 each include an O-ring groove for receiving an O-ring. As previously described, the grooves preferably include parallel side walls, a bottom wall perpendicular to one of the side walls, and an oblique wall interconnecting the bottom wall to the other side wall. The configuration of the grooves allows the O-rings to maintain a fluid-tight seal between the outer sleeve 202 and the inner conduit 204 without requiring extremely precise dimension tolerances.

The inner conduit 204 also preferably includes an annular groove 246 proximally spaced from the second distal end 238 of the inner conduit 204 and extending around the perimeter of the inner conduit 204. When the inner conduit 204 is pulled telescopically outward from the outer sleeve 202, the free ends 232 of the cantilever members 206, which are biased inward towards the inner conduit 204, cause the hooks 233 to snap into the annular groove 246 such that the inner conduit 204 is locked in the open position.

The inner conduit 204 also preferably includes a pair of longitudinal grooves 250 located directly adjacent to the second distal end 238 of the inner conduit 204. The longitudinal grooves 250 are located on opposite sides of the inner conduit 204 and have proximal walls 252 which are substantially perpendicular to the outer surface of the inner conduit 204. When the inner conduit 204 is pushed telescopically into the outer sleeve 202, the free ends 232 of the cantilever members 206, which are biased inward towards the inner conduit 204, cause the hooks 233 to snap into the longitudinal grooves 250 such that the inner conduit 204 is locked in the closed position. Contact between the proximal walls 252 and the hooks of the cantilever members 206 prevent the inner conduit 204 from being moved outward from the closed position to the open position.

The longitudinal grooves 250 each also include a pair of opposing side walls 254 which are preferably inclined such that when the inner conduit 204 is radially turned, such as by a wrench, the hooks of the cantilever members 206 slide up the inclined side walls 254 thereby allowing the inner conduit 204 to be radially turned without interference from the cantilever members 206.

A set of threads is formed in the inner surface of the inner conduit 204 adjacent to the second distal end 238 of the inner conduit 204. The threads allow the inner conduit 204 to be connected to a pipe or hose such that fluid can be dispensed from the container 201 or pumped into the container 201. It will be appreciated that when the valve 200 is not in use, a plug may be threaded into the distal end 238 of the inner conduit 204 to minimize the opportunity for leakage. Additionally, it will also be appreciated that the second distal end 238 of the inner conduit 204 preferably has a flange 248 having a polygonal perimeter, preferably octagonal. The flange 248 facilitates connecting the valve 200 to a hose or pipe by providing surfaces on to which a wrench may be applied in order to radially turn the inner conduit 204 within the outer sleeve 202. It will further be appreciated that the valve 200 may be covered with shrink wrap in order to provide evidence of tampering.

In assembling the valve 200, the first step is to place the O-rings in the grooves defined by the first and second sealing ring members 242 and 244. The proximal end 236 of the inner conduit 204 is then telescopically slid into the threaded first intermediate end 227 of the proximal piece 234 of the outer sleeve 202. Next, the distal piece 235 of the outer sleeve 202 is telescopically inserted over the distal end 238 of the inner conduit 204 and the threaded second intermediate end 229 of the distal piece 235 is threadingly joined with the first intermediate end 227 of the proximal piece 234. It will be appreciated that a tool fitting over and engaging the cantilever members 206 may be used to provide sufficient torque to threadingly join the proximal and distal pieces 234 and 235 together.

As assembled, the second sealing ring member 244 is captured between the first and second annular stops 226 and 228. Contact between the second sealing member 244 and the first stop 226 prevents the inner conduit 204 from being pulled completely from the outer sleeve 202. Additionally, contact between the second sealing ring member 244 and the second stop 228 prevents the inner conduit 204 from being pushed completely through the outer sleeve 202. Therefore, the range of telescopic motion of the inner conduit 204 is limited by the stops 226 and 228.

Once the valve 200 is assembled, the valve 200 is fastened to the container 201 preferably by heat welding. However, it will be appreciated that a variety of other conventionally known techniques may be used to fasten the valve 200 to the container 201.

In operation, the valve 200 is preferably used to dispense fluids from the flexible container 201. When the inner conduit 204 of the valve 200 is in the closed position, the first sealing ring member 242 of the inner conduit 204 is inserted within the proximal opening defined by the end ring 222 of the outer sleeve 202 such that the O-ring seal is compressed within the O-ring groove by the end ring 222 as shown in FIG. 16. In the closed position, the O-ring of the first sealing ring member 242 creates a fluid-tight seal which closes fluid communication between the open second distal end 238 of the inner conduit 204 and the inner volume of the container 201. While in the closed position, the hooked free ends 232 of the cantilever members 206 are biased within the longitudinal grooves 250 formed in the distal end 238 of the inner conduit 204. Contact between the proximal walls 252 of the longitudinal slots 250 and the hooked free ends 232 of the cantilever members 206 prevents the valve 200 from being accidentally opened.

When it is desired for the valve 200 to be opened, the cantilever members 206 are manually flexed radially outward such that the hooked free ends 232 disengage from the longitudinal slots 250 thereby allowing the inner conduit 204 to be manually pulled telescopically outward from the outer sleeve 202 until the inner conduit 204 of the valve 200 reaches the open position. In the open position, the second sealing ring member 244 is flush against the first stop 226 and the first sealing ring 242 is distally located from the proximal opening 224 of the outer sleeve 202 as shown in FIG. 15. In such a position, fluid communication is open between the interior volume of the flexible container 201 and the open second distal end 238 of the inner conduit 204. Typically, fluid is allowed to flow from the interior of the flexible container 201 through the proximal opening defined by the end ring 222 of the outer sleeve 202 into the interior of the outer sleeve 202. The fluid then typically flows through the apertures 241 in the second tapered portion 240 of the inner conduit 204 into the interior of the inner conduit 204. The fluid then typically flows through the inner conduit 204 and exits the open second distal end 238 of the inner conduit 204. It will be appreciated that the fluid may be pumped in the opposite direction through the inner conduit 204 if it is desired to pump fluid into the interior volume of the flexible container 201 rather than dispense fluid from the container 201.

While the valve 200 is in the open position, the O-ring of the second sealing member 244 forms a fluid-tight seal against the inner surface of the outer sleeve 202 in order to prevent valve leakage. Additionally, when the valve 200 is in the open position, the hooked free ends 232 of the cantilever members 206 are biased within the annular groove 246 in the inner conduit 204 such that the valve 200 is locked in the open position. In order to close the valve 200 from the open position, the cantilever members 206 are manually flexed radially away from the inner conduit 204 such that the hooked free ends 232 disengage from the annular groove 246. Once the hooked free ends 232 are disengaged from the annular groove 246, the inner conduit 204 is manually pushed telescopically into the outer sleeve 202 until the second sealing member 244 contacts the second stop 228 and the inner conduit 204 closed position. The cantilever members 206 are then released such that the hooked free ends 232 of the cantilever members 206 are biased within the longitudinal slots 250 of the inner conduit 204 to retain the inner conduit 204 in the closed position.

Thus, the present invention is described in detail, along with various embodiments. It is understood, however, that the present disclosure is illustrative only and that changes made in detail, especially in matters of shape, size, and arrangement of parts are within the principles of the invention to the full extent extended by the broad general meaning of the terms in which the appended claims are expressed.

What is claimed is:

1. An apparatus for containing and dispensing a liquid, comprising:

a container;

a valve including an outer sleeve and an inner conduit telescopically mounted within the outer sleeve, the inner conduit being selctively telescopically moveable between an open position and a closed position, the valve also including a flexible cantilever member longitudinally aligned generally along the outer sleeve and the inner conduit, the cantilever member being attached to a first one of the outer sleeve and the inner conduit, and being selectively engageable with a second one of the outer sleeve and the inner conduit to selectively retain the inner conduit in at least one of the open and closed positions, said cantilever member having a free end forming a hook and a base end connected to the inner conduit, the outer sleeve including a hook receiving means, the hook of the cantilever member selectively engaging the hook receiving means to selctively retain the inner conduit in at least one of the open and closed positions, said valve further including a thin membrane extending between the cantilever member and the inner conduit for detecting tampering with the valve; and means for fastening the container and the valve together so that liquid contained in the container can be dispenses through the valve when the inner conduit is in the open position.

2. A method for making an apparatus comprising a container having a valve for dispensing liquid from the container, the valve having an outer sleeve having open first distal and proximal ends and including distal and proximal pieces, the distal piece including a first stop and the proximal piece including a second stop, the valve also including an inner conduit having a closed second proximal end and an open second distal end, the inner conduit having at least one aperture adjacent to the second proximal end that is in fluid communication with the open second distal end of the inner conduit, the inner conduit also including an annular sealing ring member extending radially outward from the inner conduit, the method comprising the steps of:

sliding the second proximal end of the inner conduit into the proximal piece of the outer sleeve;

sliding the distal piece of the outer sleeve over the second distal end of the inner conduit such that the annular sealing ring member of the inner conduit is captured between the first and second stops of the proximal and distal pieces of the outer sleeve;

connecting the distal piece of the outer sleeve to the proximal piece of the outer sleeve; and fastening the valve to the container.

3. An apparatus for containing and dispensing a liquid, comprising:

a container;

a valve including an outer sleeve and an inner conduit telescopically mounted within the outer sleeve, the inner conduit being selectively telescopically moveable between an open position and a closed position, the valve also including a flexible cantilever member longitudinally aligned generally along the outer sleeve and the inner conduit, the cantilever member being attached to a first one of the outer sleeve and the inner conduit, and being selectively engageable with a second one of the outer sleeve and the inner conduit to selectively retain the inner conduit in at least one of the open and closed positions, said cantilever member having a base end connected to the outer sleeve and a free end forming a hook, the inner conduit including a hook receiving means, the hook of the cantilever member selectively engaging the hook receiving means to selectively retain the inner conduit in at least one of the open and closed positions, said valve further including a filament engaging the cantilever member and the inner conduit for detecting tampering of the valve; and means for fastening the container and the valve together so that liquid contained in the container can be dispenses through the valve when the inner conduit is in the open position.

* * * * *